US009875588B2

(12) United States Patent
McCollum et al.

(10) Patent No.: US 9,875,588 B2
(45) Date of Patent: Jan. 23, 2018

(54) SYSTEM AND METHOD FOR IDENTIFICATION TRIGGERED BY BEACONS

(71) Applicant: Disney Enterprises, Inc., Burbank, CA (US)

(72) Inventors: Jordan McCollum, South Pasadena, CA (US); Nitzan Katz, Los Altos, CA (US); Steven Makofsky, Sammamish, WA (US)

(73) Assignee: Disney Enterprises, Inc., Burbank, CA (US)

( * ) Notice: Subject to any disclaimer, the term of this patent is extended or adjusted under 35 U.S.C. 154(b) by 264 days.

(21) Appl. No.: 14/253,778

(22) Filed: Apr. 15, 2014

(65) Prior Publication Data

US 2015/0294514 A1 Oct. 15, 2015

(51) Int. Cl.
*G07C 9/00* (2006.01)
*G07C 11/00* (2006.01)

(52) U.S. Cl.
CPC ..... *G07C 9/00111* (2013.01); *G07C 2011/02* (2013.01)

(58) Field of Classification Search
None
See application file for complete search history.

(56) References Cited

U.S. PATENT DOCUMENTS 5,703,995 A * 12/1997 Willbanks ..... G11B 27/029 386/241
6,571,279 B1 * 5/2003 Herz ..... G06F 17/30867 707/999.01
7,970,390 B2 * 6/2011 Fraccaroli ..... H04M 3/42008 455/414.1
8,330,587 B2 * 12/2012 Kupstas ..... A63G 31/00 340/10.1
9,019,376 B2 * 4/2015 Lee ..... H04N 7/185 348/143
9,144,360 B2 * 9/2015 Ozick ..... A47L 5/30
9,230,386 B2 * 1/2016 Roh ..... G06Q 30/0224
9,313,549 B1 * 4/2016 Nusbaum ..... H04N 21/4784
2002/0052781 A1 * 5/2002 Aufricht ..... G06F 17/30902 705/14.61
2003/0013459 A1 * 1/2003 Rankin ..... G07C 1/20 455/456.1
2003/0163345 A1 * 8/2003 Itagaki ..... G06Q 30/08 705/37

(Continued)

*Primary Examiner* — Quan-Zhen Wang
*Assistant Examiner* — Chico A Foxx
(74) *Attorney, Agent, or Firm* — Farjami & Farjami LLP

(57) ABSTRACT

There is provided systems and methods of identification and automation of devices using a beacon. A system includes a beacon, an automation device, and a server. The beacon is configured to transmit a signal to the automation device in response to entering a defined geographic zone. The automation device is configured to receive the signal from the beacon, transmit, in response to receiving the signal, the signal to the server, receive an identification of a person possessing the beacon from the server, and activate an automation feature, wherein the automation feature uses the identification of the person possessing the beacon. An automation feature may include, but is not limited to, a video camera, a display device, or a stereo.

15 Claims, 5 Drawing Sheets

(56) References Cited

U.S. PATENT DOCUMENTS

2004/0122733 A1* 6/2004 Hanschen ..... G06Q 30/02 705/14.23
2004/0143602 A1* 7/2004 Ruiz ..... H04N 7/181
2007/0276726 A1* 11/2007 DiMatteo ..... G06Q 30/02 705/14.66
2008/0086236 A1* 4/2008 Saito ..... G01S 5/0252 700/245
2008/0259906 A1* 10/2008 Shkedi ..... G06Q 30/0241 370/352
2008/0263175 A1* 10/2008 Naono ..... H04L 63/12 709/217
2009/0138521 A1* 5/2009 Buster ..... G06F 17/30557
2009/0149991 A1* 6/2009 Sumida ..... G06N 3/008 700/246
2009/0294573 A1* 12/2009 Wilson ..... B64C 39/024 244/2
2013/0041976 A1* 2/2013 Hendricks ..... G06Q 30/02 709/217
2013/0046616 A1* 2/2013 Williams ..... G06Q 30/0251 705/14.45
2013/0109404 A1* 5/2013 Husney ..... H04W 4/02 455/456.1
2013/0124186 A1* 5/2013 Donabedian ..... G06F 17/289 704/2
2013/0293581 A1* 11/2013 Wissner-Gross ..... G06T 19/006 345/633
2013/0314502 A1* 11/2013 Urbach ..... H04N 7/181 348/46
2013/0331087 A1* 12/2013 Shoemaker ..... H04L 67/125 455/420
2013/0332502 A1* 12/2013 Amemiya ..... H04L 67/325 709/201
2014/0018979 A1* 1/2014 Goossen ..... G08G 5/0034 701/3
2014/0027506 A1* 1/2014 Heo ..... G06K 19/0725 235/380
2014/0222582 A1* 8/2014 Papalia ..... G06Q 30/0275 705/14.66
2014/0236728 A1* 8/2014 Wright ..... G06Q 30/0272 705/14.58
2014/0237076 A1* 8/2014 Goldman ..... G06F 17/3087 709/217
2015/0106958 A1* 4/2015 Holman ..... G06F 21/64 726/32
2015/0134143 A1* 5/2015 Willenborg ..... G05D 1/0094 701/2
2015/0195100 A1* 7/2015 Imes ..... H04L 12/282 455/420
2015/0208032 A1* 7/2015 Gavney, Jr. ..... H04N 5/232 348/14.08
2015/0318812 A1* 11/2015 O'Donnell ..... F16H 37/065 318/498
2015/0321758 A1* 11/2015 Sarna, II ..... B64C 39/024 244/63
2015/0334755 A1* 11/2015 Ayadurai ..... H04W 76/023 370/252
2016/0007098 A1* 1/2016 Southam ..... H04N 21/84 725/32
2016/0042637 A1* 2/2016 Cahill ..... G08B 25/10 701/3
2016/0059145 A1* 3/2016 Cortelyou ..... A63H 27/12 472/57
2016/0136482 A1* 5/2016 Askew, Jr. ..... A63B 24/0062 700/91

* cited by examiner

SYSTEM AND METHOD FOR IDENTIFICATION TRIGGERED BY BEACONS

BACKGROUND

Nowadays, theme parks offer guests many different forms of entertainment that provide guests with the opportunity to spend an entire day at the theme park without getting bored. Some types of entertainment at the theme parks include roller coaster rides, shows, food, drinks, and music. Guests are able to travel freely around the theme park and try to experience as much of this entertainment as possible. However, since the entertainment at the theme parks is aimed at a general group of guests, some of the guests might not feel a real connection with the entertainment. For example, programs being displayed on televisions throughout the theme park might be designed as general programs for all guests to enjoy. However, certain guests might not be interested in what is being displayed and might ignore certain programs. As another example, the speakers around the theme parks might be designed to play songs that a certain group of guests might enjoy. However, some guests might not enjoy what is playing on the speakers and may want a way to change the music to fit their own preferences.

Another form of entertainment that the theme parks offer is taking pictures of guests, either with special characters or while riding a roller coaster. After these pictures are taken, guests are then able to view and purchase the pictures they like. However, this form of entertainment has created problems for both the theme parks and the guests. For example, a theme park must place photographers in special locations throughout the theme park, such as by the characters or roller coasters. As such, photographers may not be present in all locations where a guest might want to have his or her picture taken. As another example, on roller coaster rides, it can sometimes be difficult for a guest to find his or her own picture as all of the pictures taken of the roller coaster ride are randomly displayed on a display screen outside the roller coaster.

SUMMARY

The present disclosure is directed to a system and method for identification triggered by beacons, substantially as shown in and/or described in connection with at least one of the figures, as set forth more completely in the claims.

DETAILED DESCRIPTION

Figure 1:
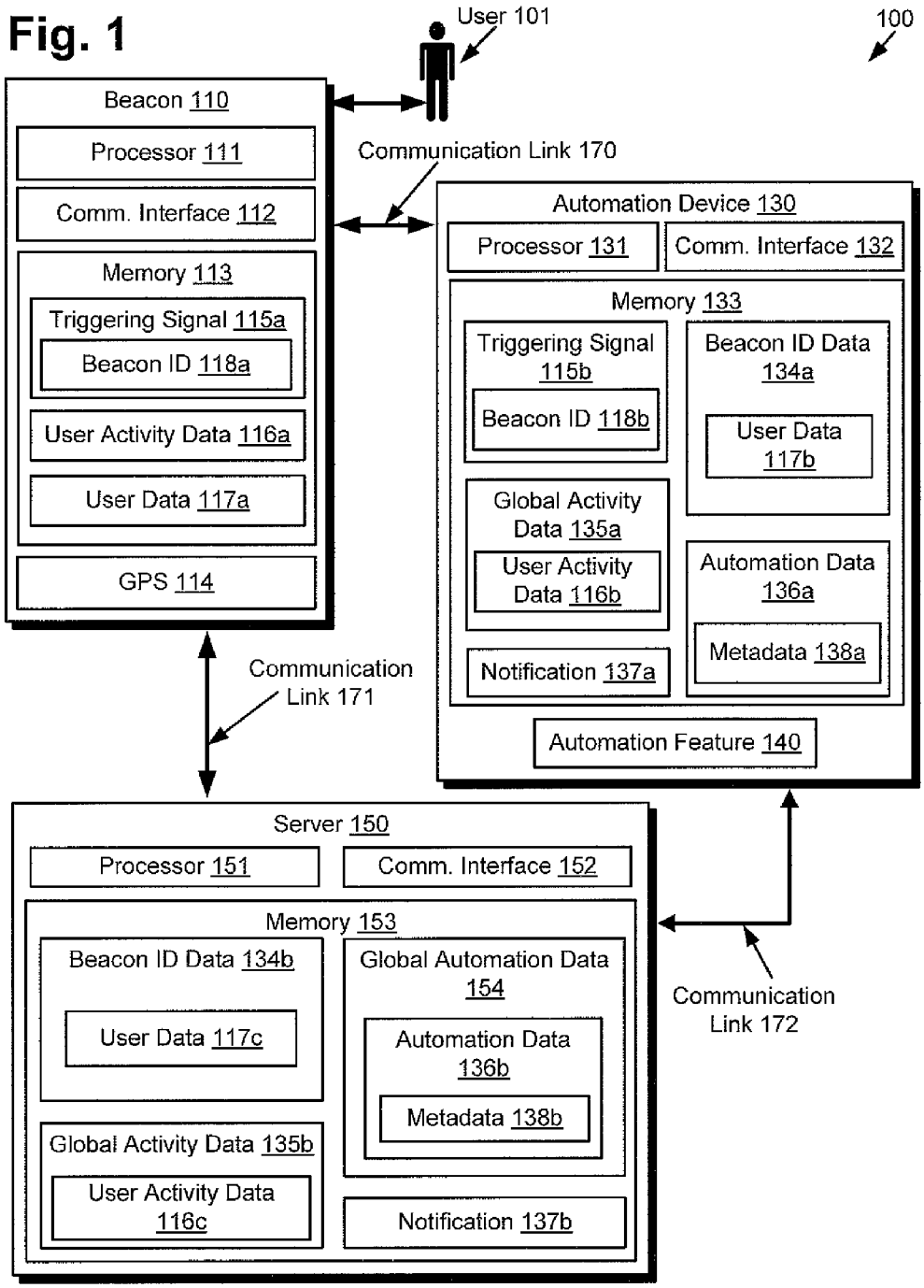
FIG. 1 presents a system for identification triggered by beacons, according to one implementation of the present disclosure.

The following description contains specific information pertaining to implementations in the present disclosure. The drawings in the present application and their accompanying detailed description are directed to merely exemplary implementations. Unless noted otherwise, like or corresponding elements among the figures may be indicated by like or corresponding reference numerals. Moreover, the drawings and illustrations in the present application are generally not to scale, and are not intended to correspond to actual relative dimensions.

FIG. 1 presents a system for identification triggered by beacons, according to one implementation of the present disclosure. System 100 of FIG. 1 includes user 101, beacon 110, automation device 130, and server 150. Beacon 110 includes processor 111, communication interface 112, memory 113, and Global Positioning System (GPS) 114. Memory 113 includes triggering signal 115*a*, user activity data 116*a*, and user data 117*a*. Triggering signal 115*a* includes beacon ID 118*a*. Automation device 130 includes processor 131, communication interface 132, memory 133, and automation feature 140. Memory 133 includes triggering signal 115*b*, beacon ID data 134*a*, global activity data 135*a*, automation data 136*a*, and notification 137*a*. Triggering signal 115*b* includes beacon ID 118*b*. Beacon ID data 134*a* includes user data 117*b*. Global activity data 135*a* includes user activity data 116*b*. Automation data 136*a* includes metadata 138*a*. Server 150 includes processor 151, communication interface 152, and memory 153. Memory 153 includes beacon ID data 134*b*, global activity data 135*b*, notification 137*b*, and global automation data 154*b*. Beacon ID data 134*b* includes user data 117*c*. Global activity data 135*b* includes user activity data 116*c*. Global automation data 154*a* includes automation data 136*b*, which includes metadata 138*b*.

As illustrated in FIG. 1, system 100 includes beacon 110, automation device 130, and server 150. Beacon 110 may include a cell phone, a radio-frequency identification (RFID) chip, a Bluetooth tag, an electronic bracelet, or any other device capable to transmitting triggering signals to automation devices, such as automation device 130. For example, beacon 110 may include a RFID chip or Bluetooth tag that a user wears on his or her clothing. In such an example, the user may attach the RFID chip or Bluetooth tag on the clothing using a clip, an adhesive, a button, or any other type of attaching mechanism. This way a user, such as user 101, always has beacon 110 attached to himself or herself while around automation devices.

Automation device 130 may include a video camera, a drone, a stereo, a television, a theme park ride, or any other device that includes automation features that can be activated by triggering signals transmitted from beacons, such as beacon 110. As such, automation device 130 may include stationary or mobile devices. For example, automation device 130 may include a stationary video camera that takes pictures when activated by beacon 110, or automation device 130 may include a drone video camera that follows beacon 110 taking pictures or videos of user 101. Furthermore, server 150 may include a person computer, a mobile phone, a tablet, or any other device capable of communicating with other devices, such as beacon 110 and automation device 130.

It should be noted that the implementation of FIG. 1 only illustrates one beacon 110, one automation device 130, and one server 150; however, the present disclosure is not limited to the implementation of FIG. 1. In other implementations, there may be any number of beacons, automation devices, and servers in communication with each other. For example, in one implementation, there may be multiple beacons transmitting triggering signals to automation device 130. For another example, in another implementation, beacon 110 may be transmitting triggering signals to multiple automation devices. Finally, for a third example, in another implementation, multiple automation devices may be in communication with server 150. Also illustrated in FIG. 1, beacon 110 includes processor 111 and memory 113. Processor 111 may be configured to access memory 113 to store received input or to execute commands, processes, or programs stored in memory 113. Processor 111 may correspond to a processing device, such as a microprocessor or similar hardware processing device, or a plurality of hardware devices. However, in other implementations processor 111 refers to a general processor capable of performing the functions required of beacon 110. Memory 113 is capable of storing commands, processes, and programs for execution by processor 111. Memory 113 may be instituted as ROM, RAM, flash memory, or any sufficient memory capable of storing a set of commands. In other implementations, memory 113 may correspond to a plurality memory types or modules.

It should be noted that each of processor 131 and memory 133 of automation device 130, and processor 151 and memory 153 of server 150 are similar to processor 111 and memory 113 of beacon 110. For example, processor 131 of automation device 130 may be configured to access memory 133 to store received input or to execute commands, processes, or programs stored in memory 133. For a second example, processor 151 of server 150 may be configured to access memory 153 to store received input or to execute commands, processes, or programs stored in memory 153.

Also illustrated in FIG. 1, beacon 110 includes communication interface 112, automation device 130 includes communication interface 132, and server 150 includes communication interface 152. Beacon 110 may utilize communication interface 112 to communicate with communication interface 132 of automation device 130 and communication interface 152 of server 150 through communication link 170 and communication link 171, respectively. Furthermore, automation device 130 may utilize communication interface 132 to communicate with communication interface 152 of server 150 through communication link 172. As such, each of communication interface 112, communication interface 132, and communication interface 152 can utilize, as examples, one or more of Wireless Fidelity (Wi-Fi), Worldwide Interoperability for Microwave Access (WiMax), ZigBee, Bluetooth, RFID, Algorithm Division Multiple Access (CDMA), Evolution-Data Optimized (EV-DO), Global System for Mobile Communications (GSM), Long Term Evolution (LTE), and other types of wired and wireless interfaces.

Also illustrated in FIG. 1, beacon 110 includes triggering signal 115*a*, which includes beacon ID 118*a*. In the implementation of FIG. 1, beacon 110 transmits triggering signal 115*a* to activate automation devices, such as automation device 130. As discussed above, beacon 110 may include a RFID chip or Bluetooth tag and thus, beacon 110 transmits triggering signal 115*a* to automation device 130 when in a defined range of automation device 130, as will be discussed in more detail with regards to FIG. 2-4. Beacon ID 118*a* includes the identification of beacon 110. As such, automation device 130 can use beacon ID 118*b* from triggering signal 115*b*, which correspond respectively to beacon ID 118*a* from triggering signal 115*a* transmitted from beacon 110, to determine which beacon transmitted triggering signal 118*b* and the identification of the user that is in possession of the beacon that transmitted triggering signal 118*b*.

For example, and using the implementation of FIG. 1, beacon 110 may transmit triggering signal 115*a* to automation device 130, where triggering signal 115*a* includes beacon ID 118*a*. Automation device 130 may receive triggering signal 115*a* including beacon ID 118*a* and store them in memory 133 as triggering signal 115*b* and beacon ID 118*b*. Automation device 130 may then utilize beacon ID 118*b* to determine that beacon 110 transmitted triggering signal 115*b* and that user 101 is in possession of beacon 110.

Also illustrated in FIG. 1, automation device 130 includes beacon ID data 134*a*. Beacon ID data 134*a* includes a listing of all the beacons that might transmit triggering signals to automation device 130 along with user data corresponding to the person that is in possession of each beacon. Automation device 130 can therefore use beacon ID data 134*a* after receiving triggering signals from beacons to determine which beacon transmitted the triggering signal and the identity of the person that is in possession of the beacon. For example, after automation device 130 receives triggering signal 115*b* from beacon 110, automation device 130 utilizes beacon ID 118*b* from triggering signal 115*b* and beacon ID data 134*a* to determine that beacon 110 transmitted triggering signal 115*b* and user 101 is in possession of beacon 110.

Also illustrated in FIG. 1, beacon ID data 134*a* includes user data 117*b*. User data 117*b* includes data about a specific person that is in possession of a beacon, such as user 101 who is in possession of beacon 110. For example, user data 117*b* may include, but is not limited to, the name of the person, the gender of the person, a location of where the person lives, the birthday of the person, television programs the person enjoys, the person's favorite music, what hobbies the person has, and what activities the person likes to do. As will be discussed in further detail below, automation device 130 uses user data 117*b* when activated to give the person in possession of the beacon that transmitted the triggering signal a more personalized experience.

It should be noted that user data 117*a* corresponds to user data 117*b*, except that user data 117*a* is stored in memory 113 of beacon 110 while user data 117*b* is stored in memory 133 of automation device 130. Furthermore, user data 117*c* and beacon ID data 134*b* correspond respectively to user data 117*b* and beacon ID data 134*a*, except that user data 117*c* and beacon ID data 134*b* are stored in memory 153 of server 150 while user data 117*b* and beacon ID data 134*b* are stored in memory 133 of automation device 130.

It should further be noted that in one implementation, beacon 110 may use triggering signal 115*a* to transmit user data 117*a* to automation device 130. In such an implementation, automation device 130 and server 150 would not include user data 117*b* and user data 117*c*, respectively. For example, beacon 110 would include user data 117*a* in triggering signal 115*a* so that when beacon 110 transmits triggering signal 115*a* to automation device 130, automation device 130 can determine the user data right from triggering signal 115*a*.

Also illustrated in FIG. 1, automation device 130 includes global activity data 135*a*. Global activity data 135*a* includes a listing of the entertainment activities that each person possessing a beacon has experienced. As such, global activity data 135*a* includes user activity data 116*b*, which corresponds to a list of the activities a single person has experienced, such as a list of activities that user 101 has experienced. Activities can include, but are not limited to, rides the person has been on, food the person has eaten, attractions the person has experienced, or characters the person met. For example, a list of activities for user 101 may include riding a roller coaster and eating at a seafood restaurant. Automation device 130 may then utilize user activity data 116*b* when activated to give user 101 a more personal experience, as will be explained in more detail below.

It should be noted that user activity data 116*a* corresponds to user activity data 116*b*, except that user activity data 116*a* is stored in memory 113 of beacon 110 while user activity data 116*b* is stored in memory 133 of automation device 130. Furthermore, global activity data 135*b* and user activity data 116*c* correspond respectively to global activity data 135*a* and user activity data 116*b*, except that global activity data 135*b* and user activity data 116*c* are stored in memory 153 of server 150 while global activity data 135*a* and user activity data 116*b* are stored in memory 133 of automation device 130.

It should further be noted that in one implementation, beacon 110 may transmit user activity data 116*a* to automation device 130 using triggering signal 115*a*. In such an implementation, beacon 110 may record all of the activities that user 101 is experiencing and save them in memory 113 as user activity data 116*a*. Furthermore, in another implementation, automation device 130 may receive global activity data 135*b* and user activity data 116*c* from server 130 using communication link 172. In such an implementation, automation devices that are in communication with server 150 may transmit activity data to server 150 as the automation devices generate the activity data. Server 150 may then store the activity data in memory 153 as global activity data 135*b*.

Also illustrated in FIG. 1, automation device 130 includes automation data 136*a*, which includes metadata 138*a*. Automation data 136*a* includes any data that may have been generated or recorded while automation device 130 was active. As such, automation data 136*a* may include, but is not limited to, pictures, movies, or interaction data between the user and automation device 130. For example, in one implementation, as will be illustrated and described in more detail in FIG. 2, automation device 130 includes a video camera. In such an implementation, automation data 136*a* includes pictures and recordings captured by automation device 130.

Metadata 138*a* includes data that is embedded in automation data 136*a* and is used to describe automation data 136*a*. For example, metadata 138*a* may include, but is not limited to, the identity of the beacon that activated automation device 130, the identity of the person in possession of the beacon that activated automation device 130, a time that automation data 136*a* was generated, or a location of where automation data 136*a* was generated. As such, automation device 130 generates metadata 138*a* after automation data 136*a* is generated or captured and then embeds metadata 138*a* into automation data 136*a*. For example, and using the example above about automation data 136*a* including a picture or recording, automation device 130 may generate metadata 138*a* and embed metadata 138*a* in automation data 136*a* after the picture or recording has been captured, where metadata 138*a* includes the identity of beacon 110 that activated automation device 130.

It should be noted that automation data 136*b* and metadata 138*b* correspond to automation data 136*a* and metadata 138*a*, respectively, except that automation data 136*b* and metadata 138*b* are stored in global automation data 154 in memory 153 of server 150 while automation data 136*a* and metadata 138*a* are stored in memory 133 of automation device 130. Global automation data 154 includes automation data from every automation device that is in communication with server 150. For example, if server 150 is in communication with ten automation devices, global automation data 154 would include the automation data from all ten automation devices.

Also illustrated in FIG. 1, automation device 130 includes notification 137*a*. Automation device 130 transmits notification 137*a* to beacons that transmitted triggering signals when automation device 130 generates or records automation data 136*a*. Notification 137*a* is used to notify the person in possession of the beacon that automation data 136*a* was generated or recorded and also where the person can get a copy of automation data 136*a*. For example, and using the example above where automation device 130 includes a video camera, automation device 130 may take a picture of user 101 in possession of beacon 110 in response to receiving triggering signal 115*a* from beacon 110. Automation device 130 may then generate and transmit notification 137*a* to beacon 110, where notification 137*a* tells user 101 that automation data 136*a* was captured and also where user 101 can get a copy of automation data 136*a*, such as a printed photograph of the picture that was taken.

It should be noted that notification 137*b* corresponds to notification 137*a*, except that server 150 transmits notification 137*b* while automation device 130 transmits notification 137*a*. For example, and using the example above where automation device 130 takes a picture of user 101, automation device 130 may transmit the picture as automation data 136*a* to server 150. Server 150 may then transmit notification 137*b* to beacon 110 to notify user 101 that automation device 130 took a picture and also where user 101 can get a copy of the picture.

Also illustrated in FIG. 1, automation device 130 includes automation feature 140. As discussed above, beacon 110 activates automation device 130 by transmitting triggering signal 115*a* to automation device 130. Automation feature 140 thus includes the feature of automation device 130 that is activated by triggering signal 115*a*. For example, and as discussed above, automation device 130 may include a video camera, a drone, a stereo, a television, a theme park ride, or any other device that includes automation features that can be activated by triggering signals from beacons, such as beacon 110. As such, automation feature 140 may include the taking of the picture for the video camera, the programs being displayed on the television, or the music being played by the stereo.

In the implementation of FIG. 1, user 101 is in the possession of beacon 110. Once user 101 enters a defined geographic zone with beacon 110, beacon 110 generates and transmits triggering signal 115*a* to automation device 130, where triggering signal 115*a* may include a RFID or Bluetooth signal. Automation device 130 then receives triggering signal 115*a* from beacon 110 and either uses beacon ID data 134*a* to determine which beacon transmitted triggering signal 115*a*, or automation device 130 communicates with server 150 to determine which beacon transmitted triggering signal 115*a*. After determining the identity of beacon 110 and user 101, automation device 130 activates automation feature 140 using the identity of beacon 110 and user 101 and, as discussed above, may generate automation data 136*a* with embedded metadata 138*a*. Finally, automation device 130 transmits notification 137*a* to beacon 110 to notify user 101 that automation data 136*a* was generated and further transmits automation data 136*a* with embedded metadata 138*a* to server 150.

It should be noted that the implementation of FIG. 1 only illustrates beacon 110 activating automation device 130, however, present disclosure is not limited to the implementation of FIG. 1. For example, in one implementation, beacon 110 may communicate with and activate other beacons that are within a geographic zone of beacon 110. For example, beacon 110 and a second beacon may compare user data with each other to look for similarities between the user data. Beacon 110 may then transmit a notification (not shown) to the second beacon in response to the comparing of the user data. For example, beacon 110 may transmit a notification to the second beacon that notifies a user in possession of the second beacon that user 101 has similar interests as that user.

It should be noted that the implementation of FIG. 1 further illustrates beacon 110 including GPS 114. In such an implementation where beacon 110 includes GPS 114, beacon 110 may utilize GPS 114 to determine the location of user 101. Beacon 110 can then transmit triggering signal 115*a* to automation device 130 when beacon 110 determines user 101 is close to automation device 130 based on GPS 114. However, the present disclosure is not limited to the implementation of FIG. 1 and in other implementations beacon 110 may not include GPS 114. In such implementations, as discussed above and as described in more details with regards to FIGS. 2-4, beacon 110 transmits triggering signal 115*a* when user 101 in possession of beacon 110 enters the defined geographic zone.

Figure 2:
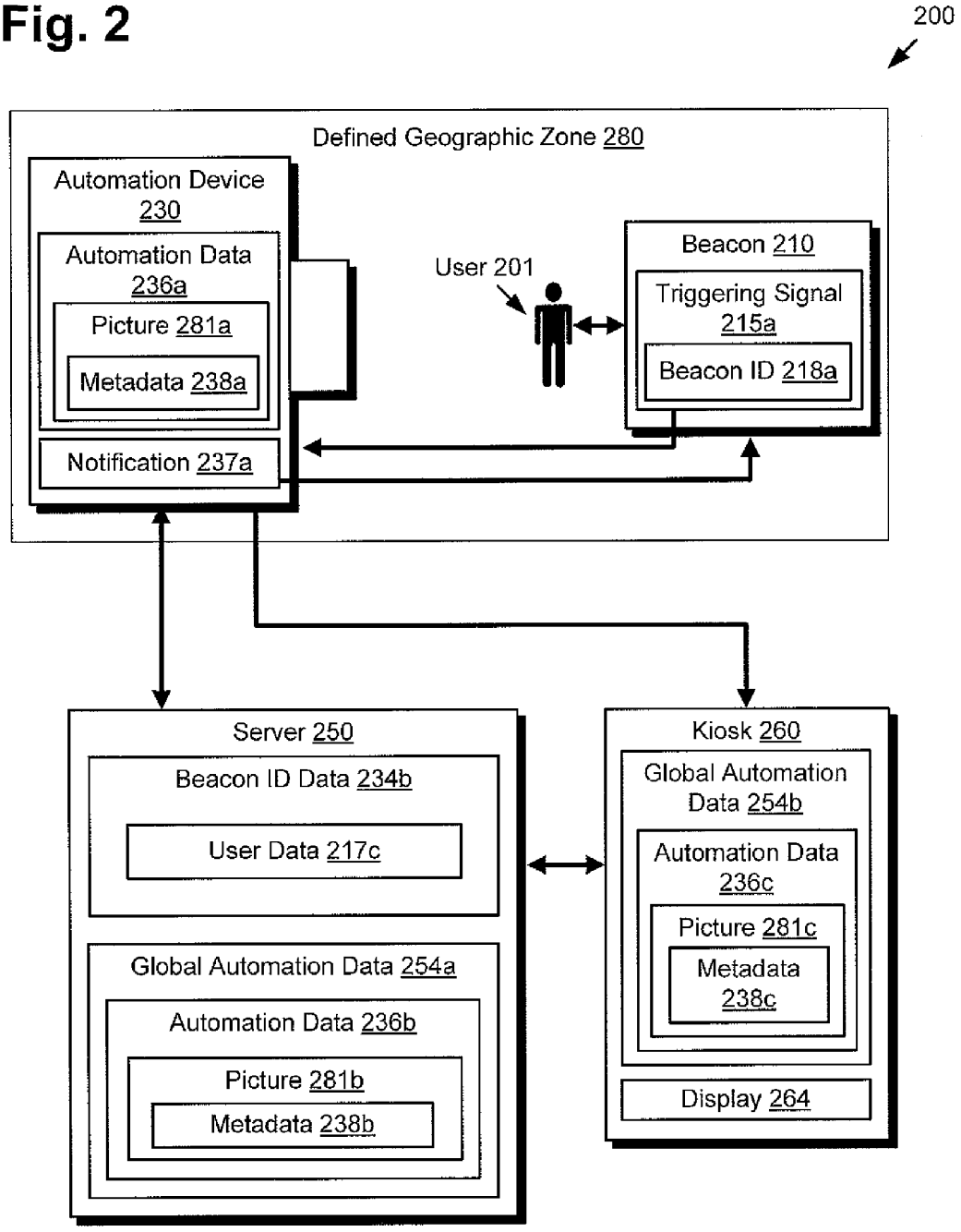
FIG. 2 presents a system of identification and automation for photo and video capture, according to one implementation of the present disclosure.
Figure 3:
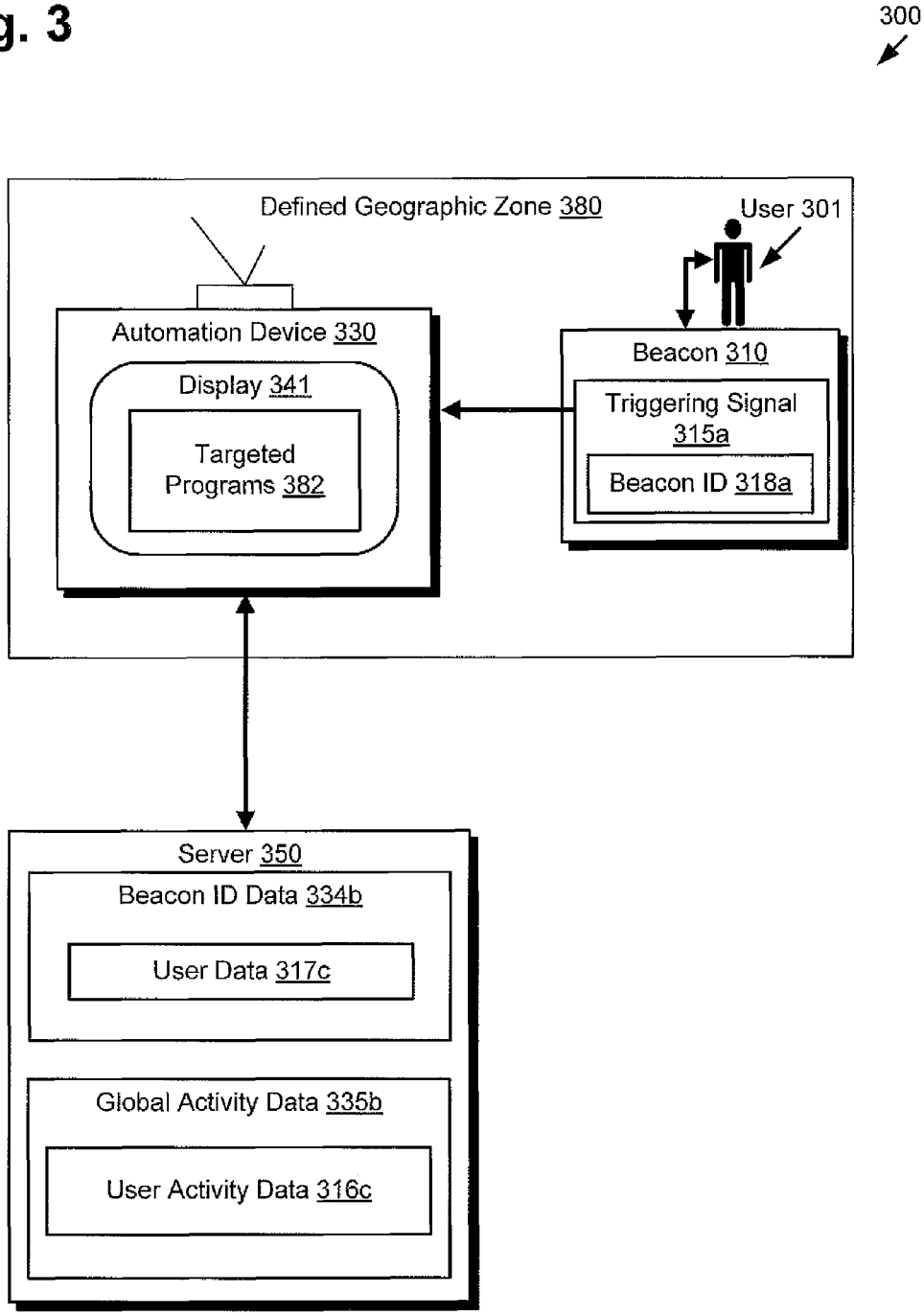
FIG. 3 presents a system of identification and automation for displaying targeted programs on a display, according to one implementation of the present disclosure.
Figure 4:
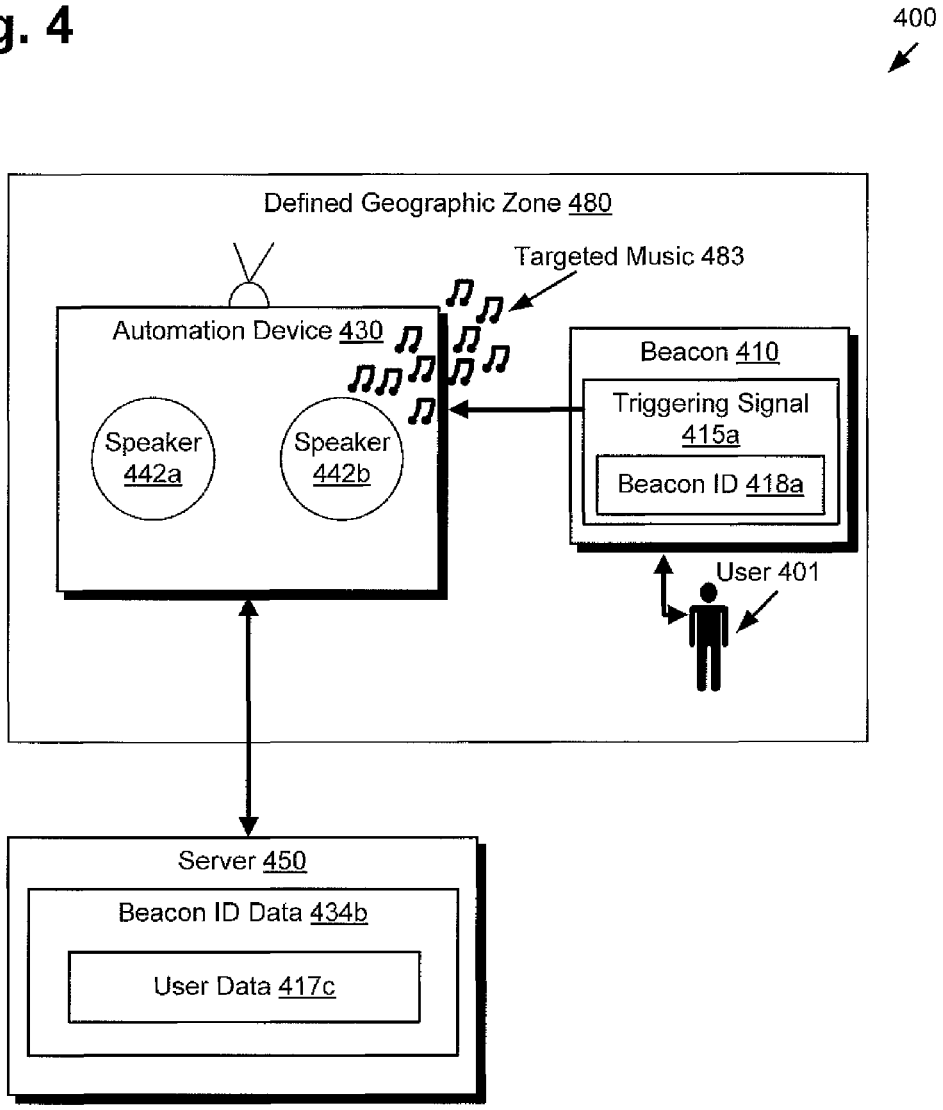
FIG. 4 presents a system of identification and automation for playing targeted music, according to one implementation of the present disclosure.

As a preliminary note to FIGS. 2-4, it should be noted that each of FIGS. 2-4 includes a defined geographic zone 280/380/480 around an automation device 230/330/430. In each implementation, the defined geographic zone around the automation device illustrates the area for which a beacon will transmit a triggering signal to activate the automation device. For example, and using FIG. 2, beacon 210 of FIG. 2 will transmit triggering signal 215*a* to automation device 230 when beacon 210 enters defined geographic zone 280.

However, it should be noted that a similar geographic zone may be illustrated as surrounding each of beacons 210/310/410 in FIGS. 2-4. For example, and as discussed above, a beacon may include a RFID chip or a Bluetooth tag. In such an example, the beacon would include a geographic zone that surrounds the beacon, where the geographic zone indicates an area around the beacon for which automation devices will automatically be activated by the beacon. The geographic zone around the beacon would thus move with any user that is in possession of the beacon. Furthermore, the beacon would automatically activate any automation devices that got within the geographic zone. For example, if the user is in a theme park with multiple automation devices, the user would attach the beacon to himself or herself. In such an example, anytime the user got close to an automation device, the automation device would automatically activated by the beacon.

FIG. 2 presents a system of identification and automation for photo and video capture, according to one implementation of the present disclosure. System 200 of FIG. 2 includes user 201, beacon 210, automation device 230, server 250, and kiosk 260. Beacon 210 includes triggering signal 215*a*, which includes beacon ID 218*a*. Automation device 230 includes automation data 236*a* and notification 237*a*. Automation data 236*a* includes picture 281*a*, which includes metadata 238*a*. Server 250 includes beacon ID data 234*b* and global automation data 254*a*. Beacon ID data 234*b* includes user data 217*c*. Global automation data 254*a* includes automation data 236*b*. Automation data 236*b* includes picture 281*a*, which includes metadata 238*b*. Kiosk 260 includes global automation data 254*b* and display 264. Global automation data 254*b* includes automation data 236*c*. Automation data 236*c* includes picture 281*c*, which includes metadata 238*c*. System 200 further includes defined geographic zone 280.

With regards to FIG. 2, it should be noted that user 201, beacon 210, triggering signal 215, user data 217*c*, beacon ID 218*a*, automation device 230, beacon ID data 234*b*, automation data 236*a*, automation data 236*b*, notification 237*a*, metadata 238*a*, metadata 238*b*, and global automation data 254 correspond respectively to user 101, beacon 110, triggering signal 115*a*, user data 117*c*, beacon ID 118*a*, automation device 130, beacon ID data 134*b*, automation data 136*a*, automation data 136*b*, notification 137*a*, metadata 138*a*, metadata 138*b*, and global automation data 254*a* from FIG. 1. Furthermore, many features from FIG. 1 have been left out of FIG. 2 for clarity purposes.

In the implementation of FIG. 2, automation device 230 includes a video camera. As such, automation device 230 is configured to capture pictures or record videos of users in response to receiving triggering signals from beacons, such as taking picture 281*a* of user 201 in response to receiving triggering signal 215*a* from beacon 210. Beacon 210 transmits triggering signal 215*a* to automation device 230 when beacon 210 enters defined geographic zone 280. Defined geographic zone 280 includes a defined area around automation device 230 for which automation device 230 can capture a picture or record a video of a person that is in possession of a beacon, such as user 201 in possession of beacon 210. As such, beacon 210 may be automatically configured to transmit triggering signal 215*a* to automation device 210 once beacon 210 enters defined geographic zone 280.

It should be noted that the implementation of FIG. 2 illustrates defined geographic zone 280 surrounding automation device 230, however, as discussed above, beacon 210 may include a similar geographic zone. For example, beacon 210 may include a RFID chip or Bluetooth tag. In such an example, beacon 210 would automatically activate automation device 230 when user 201 in possession of beacon 210 gets close enough to automation device 230 so that automation device 230 is within the geographic zone that surrounds beacon 210. The geographic zone that surrounds beacon 210 is thus similar to defined geographic zone 280 surrounding automation device 230, except that the geographic zone around beacon 210 moves with user 201 who is in possession of beacon 210. User 201 is thus able to activate any automation devices that enter the geographic zone surrounding beacon 210.

It should further be noted that besides just activating automation device 230, beacon 210 may further be configured to help direct automation device 230 when taking picture 281*a*. For example, automation device 230 may determine and use the location of beacon 210 to adjust the camera for better pictures or videos of user 201. In adjusting the camera, automation device 230 may adjust the orientation and camera configuration settings of the camera, such as, but not limited to, the focus or zoom of the camera. Furthermore, if automation device 230 is a drone camera that is mobile, as will be discussed in greater detail below, automation device 230 can further use the location of beacon 210 to reposition itself to take better pictures or videos of user 201. Repositioning automation device 230 may include moving closer to beacon 210 to take better pictures of user 201, or following beacon 210 to take videos of user 210. This way, automation device 210 is able to adjust itself based on the location of beacon 210 in order to take the best possible pictures of user 201.

Also illustrated in the implementation of FIG. 2, automation device 230 communicates with server 250 in response to receiving triggering signal 215*a* from beacon 210. For example, in response to receiving triggering signal 215*a* from beacon 210, automation device 230 may transmit beacon ID 218*a* from triggering signal 215*a* to server 250. Server 250 may then use beacon ID data 234*b* and beacon ID 218*a* to determine that beacon 210 transmitted triggering signal 215*a* to automation device 210 and that user 201 is in possession of beacon 210. Server 250 will then transmit the identity of the beacon 210 and user 201 to automation device 230 as user data 217*c*.

After receiving user data 217*c* from server 250, automation device 230 generates metadata 238*a*, which may include the identity of beacon 210 and user 201, and embeds metadata 238*a* in picture 281*a*. Finally, automation device 230 transmits notification 237*a* to beacon 210, which notifies user 201 that picture 281*a* was captured, and transmits picture 281*a* with embedded metadata 238*a* to server 250. Server 250 stores picture 281*a* with embedded metadata 238*a* as picture 281*b* with embedded metadata 238*b*.

As further illustrated in the implementation of FIG. 2, system 200 includes kiosk 260. In the implementation of FIG. 2, automation data 236*c*, metadata 238*c*, global automation data 254*b*, and picture 281*c* of Kiosk 260 correspond respectively to automation data 236*a*/236*b*, metadata 238*a*/238*b*, global automation data 254*a*, and picture 281*a*/281*b*, except that automation data 236*c*, metadata 238*c*, global automation data 254*b*, and picture 281*c* are stored in kiosk 260. As such, automation device 230 or server 250 may transmit pictures taken from automation device 230 to kiosk 260, such as picture 281*c*. User 201 may then use kiosk 260 to view picture 281*c* using display 264, where display 264 may include a liquid crystal display (LCD) screen built into kiosk 260. Finally, user 201 can print picture 281*c* using a printer (not shown) built into kiosk 260.

It should be noted that the implementation of FIG. 2 only discusses automation device 230 as being stationary, however, the present disclosure is not limited to automation device 230 being stationary. For example, in one implementation, automation device 230 may correspond to a drone that includes a video camera and a beacon sensor. In, such an implementation, automation device 230 may take aerial photographs of user 201 when beacon 210 gets within range of the beacon sensor on automation device 230. The aerial photographs of user 201 are then tagged with metadata 238*a*, where, as discussed above, metadata 238*a* can include the identity of beacon 210 or the identity of user 201.

For example, in one implementation, user 201 may be participating in a race with other users, where each user in the race includes a beacon 210 attached to his or her clothing. In such an example, the racecourse would include multiple automation devices located throughout the racecourse, such as automation device 230, that take pictures or videos of the users when the users get into proximity of the automation devices. The automation devices may either be stationary, which would take pictures of each user and embed the pictures with metadata that includes the identity of the beacon and the identity of the user in possession of the beacon. The automation devices may further be drones, which follow the users as the users are moving throughout the racecourse. The drones would then take pictures or videos of the users and embed the pictures or videos with metadata that includes the identity of the beacon and the identity of the user in possession of the beacon.

FIG. 3 presents a system of identification and automation for displaying targeted programs on a display, according to one implementation of the present disclosure. System 300 includes user 301, beacon 310, automation device 330, and server 350. Beacon 310 includes triggering signal 315*a*, which includes beacon ID 318*a*. Automation device 330 includes display 341, which includes targeted programs 382. Server 350 includes beacon ID data 334*b* and global activity data 335*b*. Beacon ID data 334*b* includes user data 317*c*. Global activity data 335*b* includes user activity data 316*c*.

With regards to FIG. 3, it should be noted that user 301, beacon 310, triggering signal 315*a*, user activity data 316*c*, user data 317*c*, beacon ID 318*a*, automation device 330, beacon ID data 334*b*, global activity data 335*b*, and server 150 correspond respectively to user 101, beacon 110, triggering signal 115*a*, user activity data 116*c*, user data 117*c*, beacon ID 118*a*, automation device 130, beacon ID data 134*b*, global activity data 135*b*, and server 150 from FIG. 1. Furthermore, many features from FIG. 1 have been left out of FIG. 3 for clarity purposes.

In the implementation of FIG. 3, automation device 330 includes a television or other displaying device. As such, automation device 330 includes display 341 which is used to display targeted programs 382 to guests, as will be explained in greater detail below. Display 341 may include a LCD screen built into automation device 310, or display 341 may be another type of display hardware, such as cathode-ray tubes (CRT) monitors.

As illustrated in the implementation of FIG. 3, automation device 310 receives triggering signal 315*a* from beacon 310 in response to beacon 310 entering defined geographic area 380. Automation device 330 then transmits beacon ID 318*a* from triggering signal 315*a* to server 350 and server 350 determines the identity of beacon 310 and user 301 in possession of beacon 310 using beacon ID data 334*b*, where the identity of beacon 310 and user 301 correspond to user data 317*c*. Server 150 then uses user data 317*c* to determine user activity data 316*c* for user 301. Next, server 350 transmits user data 317*c*, along with user activity data 316*c*, to automation device 330. Finally, automation device 330 utilizes user data 317*c* and user activity data 316*c* to generate and display targeted programs 382 to user 301.

Targeted programs 382 are programs displayed by automation device 330 that are targeted towards user 301 using user data 317*c* and/or user activity data 316*c*. As such, targeted programs 382 may include, but are not limited to, advertisements, television programs, video games, theme park updates such as line times for rides, or promotional offers, all of which are targeted towards user 301. For example, automation device 330 may utilize user data 317*c* to determine what types of food user 301 prefers. In such an example, automation device 330 may then display targeted advertisements that are directed towards restaurants that serve those types of food to user 301. For another example, automation device 330 may utilize user activity data 316*c* to determine that user 301 has not yet been on a popular roller coaster. In such an example, automation device 330 may then display directions to the popular roller coaster along with an estimated wait time for the roller coaster to user 301.

It should be noted that different automation devices may be configured to work together using a server. For example, in one implementation, both automation device 230 from FIG. 2 corresponding to a video camera and automation device 330 from FIG. 3 corresponding to a display device may be configured to work together using a server. In such an example, automation device 230 may have captured and transmitted pictures of a user in possession of a beacon to the server. The server may then transmit the pictures to automation device 330, along with user data of the user, in response to automation device 330 receiving a triggering signal from the beacon. Automation device 330 may then be configured to display the pictures to the user.

FIG. 4 presents a system of identification and automation for playing targeted music, according to one implementation of the present disclosure. System 400 includes user 401, beacon 410, automation device 430, and server 450. Beacon 410 includes triggering signal 415*a*, which includes beacon ID 418*a*. Automation device 430 includes speaker 442*a* and speaker 442*b*, collectively referred to as speakers 442. Server 450 includes beacon ID data 434*b*. Beacon ID data 434*b* includes user data 417*c*.

With regards to FIG. 4, it should be noted that user 401, beacon 410, triggering signal 415*a*, user data 417*c*, beacon ID 418*a*, automation device 430, beacon ID data 434*b*, and server 450 correspond respectively to that user 101, beacon 110, triggering signal 115*a*, user data 117*c*, beacon ID 118*a*, automation device 130, beacon ID data 134*b*, and server 150 from FIG. 1. Furthermore, many features from FIG. 1 have been left out of FIG. 4 for clarity purposes.

In the implementation of FIG. 4, automation device 410 includes a stereo with speakers 442 for playing targeted music 483 for users in possession of beacons. For example, in the implementation of FIG. 4, automation device 430 transmit beacon ID 418*a* to server 450 in response to receiving triggering signal 415*a* from beacon 410, where beacon 410 transmits triggering signal 415*a* to automation device 430 in response to user 401 entering defined geographic zone 480. Server 450 then uses beacon ID 418*a* and beacon ID data 434*b* to determine the identity of beacon 410 and the identity of user 401 who is in possession of beacon 410, where the identity of beacon 410 and user 401 correspond to user data 417*c*. Server 450 then transmits user data 417*c* to automation device 430. Finally, automation device 430 utilizes user data 417*c*, which may further include the preferred music of user 401, to select and play targeted music 483 to user 401 using speakers 442.

It should be noted that the implementation of FIG. 4 only shows one user 401 transmitting a triggering signal 415*a* to automation device 430 using beacon 410, however, the present disclosure is not limited to the implementation of FIG. 4. For example, in other implementations, many users may transmit triggering signals to automation device 430 using beacons and automation device 430 may receive user data from server 450 for each of the users. Automation device 430 may then use all of the user data received to select and play targeted music 483 that best fits the entire group of users. For example, automation device 430 may select and play a song as targeted music 483 that is preferred by most of the users.

Figure 5:
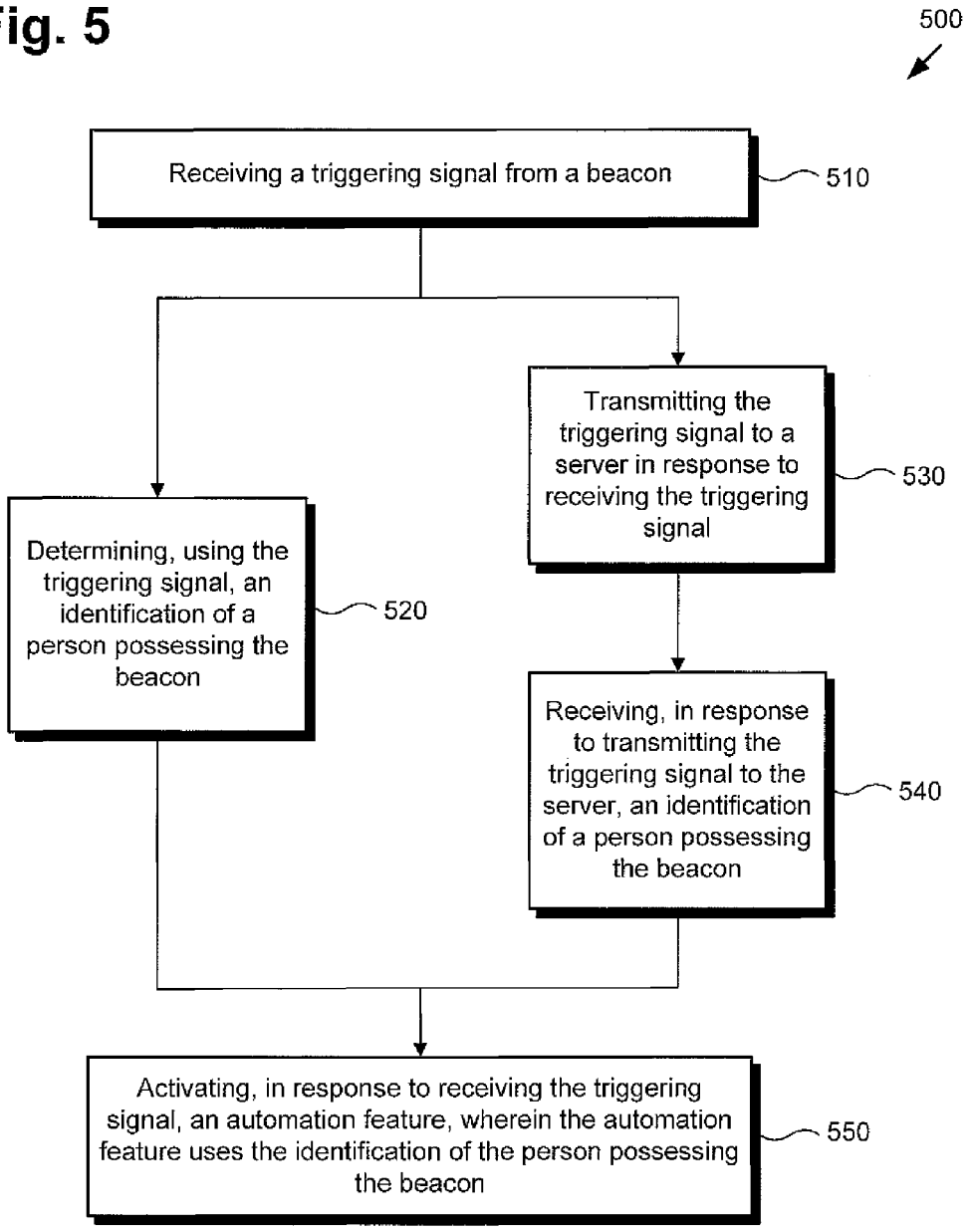
FIG. 5 shows a flowchart illustrating a method for identification triggered by beacons, according to one implementation of the present disclosure.

FIG. 5 shows a flowchart illustrating a method for identification triggered by beacons, according to one implementation of the present disclosure. The approach and technique indicated by flowchart 500 are sufficient to describe at least one implementation of the present disclosure, however, other implementations of the disclosure may utilize approaches and techniques different from those shown in flowchart 500. Furthermore, while flowchart 500 is described with respect to FIG. 1, the disclosed inventive concepts are not intended to be limited by specific features shown and described with respect to FIG. 1. Furthermore, with respect to the method illustrated in FIG. 5, it is noted that certain details and features have been left out of flowchart 500 in order not to obscure the discussion of inventive features in the present application.

Referring to flowchart 500 of FIG. 5, flowchart 500 includes receiving a triggering signal from a beacon (510). For example, processor 131 of automation device 130 may receive triggering signal 115*a* from beacon 110 through communication link 170. As discussed above, beacon 110 may include a RFID chip or Bluetooth tag. As such, beacon 110 may transmit triggering signal 115*a* to automation device 130 when in a defined range of automation device 130, such as defined geographic zone 280/380/480 from FIGS. 2-4.

Flowchart 500 also includes determining, using the triggering signal, an identification of a person possessing the beacon (520). For example, processor 131 of automation device 130 may utilize beacon ID 118*b* from triggering signal 115*b* and beacon ID data 134*a* to determine user data 117*b*. As discussed above, user data 117*b* includes the identity of beacon 110 and user 101, where user 101 is in possession beacon 110.

Alternatively, flowchart 500 may include transmitting the triggering signal to a server in response to receiving the triggering signal (530) and receiving, in response to transmitting the triggering signal to the server, an identification of a person possessing the beacon (540). For example, processor 131 of automation device 130 may transmit triggering signal 115*a* including beacon ID 118*a* to server 150 in response to receiving triggering signal 115*a* from beacon 110. Processor 131 of automation device 130 may then receive, in response to transmitting triggering signal 115*a* to server 150, user data 117*c*. As discussed above, user data 117*c* includes the identity of beacon 110 and user 101, where user 101 is in possession of beacon 101.

Flowchart 500 also includes activating, in response to receiving the triggering signal, an automation feature, wherein the automation feature uses the identification of the person possessing the beacon (530). For example, processor 131 of automation device 130 may activate, in response to receiving triggering signal 115*b* from beacon 110, automation feature 140, wherein automation feature 140 uses user data 117*b*/117*c*. As discussed above, and as illustrated in FIGS. 2-4, automation device 230 may include, but is not limited to, a video camera, a display device, or a stereo. Automation feature 140 may thus include taking a picture of user 101, displaying targeted programs to user 101, or playing targeted music to user 101.

For example, in the implementation of FIG. 2, automation feature 140 includes taking a picture of user 101 as picture 281*a* and embedding picture 281*a* with metadata 238*a*. For another example, in the implementation of FIG. 3, automation feature 140 includes utilizing user data 117*b* to select and display targeted programs 382 to user 101. Finally, for a third example, in the implementation of FIG. 4, automation feature 140 includes utilizing user data 117*b* to select and play targeted music 483 to user 101.

From the above description it is manifest that various techniques can be used for implementing the concepts described in the present application without departing from the scope of those concepts. Moreover, while the concepts have been described with specific reference to certain implementations, a person of ordinary skill in the art would recognize that changes can be made in form and detail without departing from the scope of those concepts. As such, the described implementations are to be considered in all respects as illustrative and not restrictive. It should also be understood that the present application is not limited to the particular implementations described above, but many rearrangements, modifications, and substitutions are possible without departing from the scope of the present disclosure.

What is claimed is:

1. A system for use in a theme park, the system comprising:

a beacon in the theme park; and an automation device in the theme park, the automation device having a processor configured to:

receive, via a communication interface of the automation device, a signal from the beacon, the signal comprising an identification of a first person possessing the beacon;

determine, using the identification of the first person possessing the beacon, at least one of a birthday of the first person and where the first person lives; and activate, in response to receiving the signal and the determining of the at least one of the birthday of the first person and where the first person lives, an automation feature of the automation device, wherein activating the automation feature includes communicating with a display device to display a targeted program selected based on the determined at least one of the birthday of the first person and where the first person lives;

wherein the beacon is further configured to communicate with a second beacon corresponding to a second person having a second user data and second activity data, compare the second user data and the second activity data with a first user data and a first activity data of the first person, respectively, to determine a similarity, and transmit a notification relating to the similarity to the second beacon in possession of the second person to inform the second person of the similarity, wherein the first activity data corresponds to first experiences of the first person in the theme park, and wherein the second activity data corresponds to second experiences of the second person in the theme park.

2. The system of claim 1, wherein the at least one of the birthday of the first person and where the first person lives are part of a first user data associated with the first person.

3. The system of claim 2, wherein the signal includes the first user data.

4. The system of claim 2, wherein the first user data is obtained from a server using the signal.

5. The system of claim 1, wherein to determine the identification of the first person possessing the beacon, the processor is further configured to:

transmit the signal to a server in response to receiving the signal from the beacon; and receive the identification from the server.

6. The system of claim 1, wherein the processor receives the signal from the beacon in response to the beacon entering a defined geographic zone.

7. The system of claim 1, wherein the targeted program is selected based on the first activity data of the first person obtained using the identification of the first person possessing the beacon.

8. The system of claim 7, wherein the first activity data comprises a ride the first person has been on, a food the first person has eaten, an attraction the first person has experienced, or a character the first person met.

9. A system for use in a theme park, the system comprising a beacon in the theme park;

an automation device in the theme park; and a server;

the beacon configured to:

transmit a signal to the automation device in response to entering a defined geographic zone, the signal comprising an identification of a first person possessing the beacon;

the automation device configured to:

receive the signal from the beacon via a communication interface of the automation device;

transmit the signal to the server, in response to receiving the signal comprising the identification of the first person possessing the beacon;

receive, in response to transmitting from the server, at least one of a birthday of the first person and where the first person lives; and activate, in response to receiving the signal and the receiving of the at least one of the birthday of the first person and where the first person lives, an automation feature of the automation device, wherein activating the automation feature includes communicating with a display device to display a targeted program selected based on the determined at least one of the birthday of the first person and where the first person lives;

wherein the beacon is further configured to communicate with a second beacon corresponding to a second person having a second user data and second activity data, compare the second user data and the second activity data with a first user data and a first activity data of the first person, respectively, to determine a similarity, and transmit a notification relating to the similarity to the second beacon in possession of the second person to inform the second person of the similarity, wherein the first activity data corresponds to first experiences of the first person in the theme park, and wherein the second activity data corresponds to second experiences of the second person in the theme park.

10. The system of claim 9, wherein the at least one of the birthday of the first person and where the first person lives are part of a first user data associated with the first person.

11. A method of activating an automation device having a camera, a communication interface and a processor, the method comprising:

receiving, using the processor and via the communication interface, a signal from a beacon, the signal comprising an identification of a first person possessing the beacon;

determining, using the identification of the first person possessing the beacon, at least one of a birthday of the first person and where the first person lives; and activating, in response to receiving the signal and the determining of the at least one of the birthday of the first person and where the first person lives, an automation feature of the automation device, wherein activating the automation feature includes communicating with a display device to display a targeted program selected based on the determined at least one of the birthday of the first person and where the first person lives;

wherein the beacon is further configured to communicate with a second beacon corresponding to a second person having a second user data and second activity data, compare the second user data and the second activity data with a first user data and a first activity data of the first person, respectively, to determine a similarity, and transmit a notification relating to the similarity to the second beacon in possession of the second person to inform the second person of the similarity, wherein the first activity data corresponds to first experiences of the first person in the theme park, and wherein the second activity data corresponds to second experiences of the second person in the theme park.

12. The method of claim 11, wherein the at least one of the birthday of the first person and where the first person lives are part of a user data associated with the first person.

13. The method of claim 12, wherein the signal includes the user data.

14. The method of claim 11, wherein to determine the identification of the first person possessing the beacon, the method includes:

transmitting the signal to a server in response to receiving the signal from the beacon; and receiving the identification from the server.

15. The method of claim 11, wherein the beacon transmits the signal to the automation device in response to the beacon entering a defined geographic zone.

* * * * *